US007562688B2

(12) United States Patent
Wetsema

(10) Patent No.: US 7,562,688 B2
(45) Date of Patent: Jul. 21, 2009

(54) BEARING CRADLE

(75) Inventor: Jan Pieter Wetsema, Rotterdam (NL)

(73) Assignee: Hunter Douglas Industries BV, El Rotterdam (NL)

( * ) Notice: Subject to any disclaimer, the term of this patent is extended or adjusted under 35 U.S.C. 154(b) by 100 days.

(21) Appl. No.: 11/552,622

(22) Filed: Oct. 25, 2006

(65) Prior Publication Data

US 2007/0089838 A1 Apr. 26, 2007

(30) Foreign Application Priority Data

Oct. 26, 2005 (EP) ..... 05077460

(51) Int. Cl.
*E06B 9/262* (2006.01)

(52) U.S. Cl. ..... 160/84.02; 160/84.06; 160/171; 160/172

(58) Field of Classification Search ..... 160/84.05, 160/84.04, 84.02, 172 R, 84.06, 268.1, 168.1 R, 160/121.1, 170, 171, 173 R, 178.1 R
See application file for complete search history.

(56) References Cited

U.S. PATENT DOCUMENTS 2,701,012 A * 2/1955 Loucony ..... 160/176.1 R
4,852,627 A * 8/1989 Peterson et al. ..... 160/84.02
5,515,898 A * 5/1996 Alcocer ..... 160/84.02
5,538,066 A * 7/1996 Liu ..... 160/173 R
5,553,649 A * 9/1996 Chisaka et al. ..... 160/168.1 R
6,095,228 A * 8/2000 Liu ..... 160/173 R
6,119,755 A * 9/2000 Oskam ..... 160/84.02
6,230,784 B1 * 5/2001 Sanz et al. ..... 160/84.02
6,273,173 B1 * 8/2001 Lassen ..... 160/84.06
6,644,373 B2 * 11/2003 Palmer ..... 160/168.1 R
6,745,969 B1 * 6/2004 Gouda ..... 242/375
6,832,641 B1 * 12/2004 Sanz et al. ..... 160/90
6,942,003 B2 * 9/2005 Thompson ..... 160/268.1
7,028,739 B2 * 4/2006 Hsu ..... 160/173 R
7,100,663 B2 * 9/2006 Zhang et al. ..... 160/89
2006/0118248 A1 * 6/2006 Anderson et al. ..... 160/84.04
2006/0124797 A1 * 6/2006 Liu ..... 242/400
2006/0249264 A1 * 11/2006 Lin ..... 160/171
2007/0181265 A1 * 8/2007 Cheng ..... 160/173 R

FOREIGN PATENT DOCUMENTS

GB 2 333 314 A 7/1999

* cited by examiner

*Primary Examiner*—Blair M. Johnson
*Assistant Examiner*—Jaime F Cardenas-Garcia
(74) *Attorney, Agent, or Firm*—Dorsey & Whitney LLP

(57) ABSTRACT

A cradle for rotatably supporting at least one drive spool for a window covering about which a drive cord is windable includes a pair of left and right bearing blocks in side-by-side relationship, a bottom web connecting the left and right bearing blocks and a first opening in the bottom of the cradle for at least one cord portion of the drive cord to extend through and wherein the cradle further includes at least one cord guide on the bottom web or on one of the bearing blocks.

9 Claims, 3 Drawing Sheets

BEARING CRADLE

CROSS REFERENCE TO RELATED APPLICATION

This application claims priority to European patent application No. 05077460, filed 26 Oct. 2005, which is hereby incorporated by reference as if fully disclosed herein.

BACKGROUND OF THE INVENTION

1. Field of the Invention

This invention relates to a covering for an architectural opening, especially a window blind or shade, with two oppositely fixed rails and a movable rail arranged for parallel movement between them.

2. Description of the Related Art

Window coverings are known from GB 2,333,314 which include: a fixed first rail; a movable second rail, parallel to the fixed first rail; a collapsible and extendible blind or shade which is between the fixed first rail and the movable second rail; at least one rotary drive spool mounted on the fixed first rail; at least one driving cord that is wound about the spool with at least one winding and a first drive cord section extending from the spool towards and operatively attached to the movable rail and a second drive cord section extending from the spool in a loop via a fixed surface spaced from the fixed first rail and beyond the movable second rail to the movable second rail where it is operatively attached, and means for reversibly rotating the rotary drive spool to drive the driving cord and to effect movement of the movable second rail to collapse or extend the blind or shade It is also known, specifically from FIG. 4 of GB 2,333,314, to provide such cord driven blinds with two adjacent cord drive spools. In the embodiment of FIG. 4 of GB 2,333,314, the cord routing of the drive cords is such that the cords extend perpendicular to the axis of the spool such that the cords are easily spooled about the cords spool.

Each cord spool needs to be positioned adjacent the openings of the shade through which is will be threaded. The drive cords and their drive cord sections that are routed through or parallel to the shade, need to be equidistantly spaced along the width of the rails and the covering of in order to assure that the movable second rail during operation of the blind, remains parallel to the fixed rail. In blinds where a plurality of drive cords and cord spools are present and the spools are motor-driven, it is preferred that spools are operatively connected to each other and to the motor, in order for a single motor to drive both spools. This can be a problem in blinds in which additional equipment such as a motor, timer, transformer, infrared remote control receiver, radio frequency remote control receiver, etc. also has to be in the head rail. In such a case, there is less space in the head rail to organise and place the spools in the proper location in relation to the openings for the cords. Thus situations will occur in which the cord sections extending from a drive spool need to be guided first along a portion of the fixed rail before extending through or parallel to the window covering.

As a solution to this problem cord guides have been used that are positioned adjacent or spaced apart from the driven cord spools. Examples of cord guiding pulleys are shown in U.S. Pat. No. 5,515,898 and U.S. Pat. No. 4,852,627. Different cord routing schemes will result in different parts and positions thereof for the blind.

It is an object of the invention to provide cord guiding means for the drive cords of a blind that can be used for any type of cord routing scheme.

SUMMARY OF THE INVENTION

In accordance with one aspect of this invention, a cradle is provided for rotatably supporting at least one drive spool for a window covering about which a drive cord is windable, said cradle comprising:

- a pair of left and right bearing blocks in side-by-side relationship;
- a bottom web connecting the left and right bearing blocks; and
- a first opening in the bottom of the cradle for at least one cord portion of the drive cord to extend through; and
- the cradle further including at least one cord guide on the bottom web or on one of the bearing blocks.

According to further aspects of the invention:

- the left and right bearing blocks can each further include an inner lower base wall and the bottom web can comprise a front and rear parallel bottom webs connecting said left and right inner lower base walls such that the first opening is a central opening;
- the cord guide can include a body projecting from said bottom web or bearing block and said body delimiting a cord guiding space between said body and one of the bottom web or an adjacent bearing block;
- the cord guiding space can be in open connection with the first opening by an entrance;
- the entrance can include at least a portion of minimal width that is of a width equal or slightly less than the cross-sectional size of a drive cord; and/or
- the cord guide can project from said front or rear bottom web into said central opening and the entrance can be shaped by a cord retaining flange projecting under a slope from the guide body towards the left or right inner base wall thereby creating the funnel-like entrance forming an open connection between the central opening and the cord guiding space.

According to a second aspect of the invention, a window covering is provided comprising:

- a fixed first rail;
- a movable second rail, parallel to the fixed first rail;
- a collapsible and extendible blind or shade which is between the fixed first rail and the movable second rail;
- at least one rotary drive spool mounted on the fixed first rail;
- at least one driving cord that is wound about the spool with at least one winding and at least on cord section extending tangentially from the spool towards and operatively attached to the movable rail; and
- means for reversibly rotating the rotary drive spool to drive the driving cord and to effect movement of the movable second rail to collapse or extend the blind or shade; and
- the drive spool being mounted in a cradle and the cradle comprising:
  - a pair of left and right bearing blocks in side-by-side relationship,
  - a bottom web connecting the left and right bearing blocks and
  - a first opening in the bottom of the cradle for at least one cord portion of the drive cord to extend through and
  - the cradle further including at least one cord guide on the bottom web or on one of the bearing blocks.

BRIEF DESCRIPTION OF THE DRAWINGS

Further aspects of the invention will be apparent from the detailed description below of particular embodiments and the drawings thereof, in which.

DETAILED DESCRIPTION OF THE PREFERRED EMBODIMENTS

Figure 1:
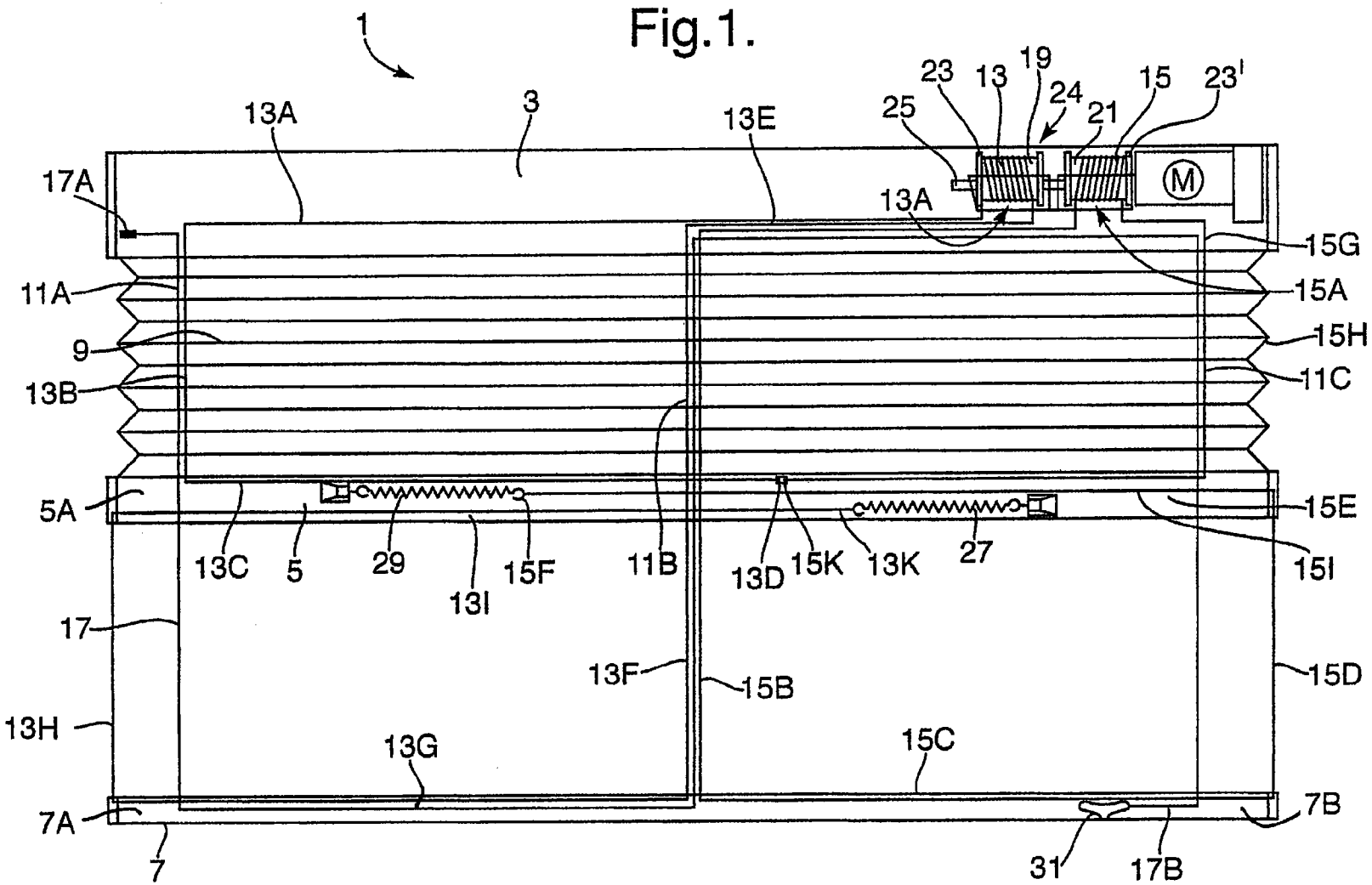
FIG. 1 is a schematic view of a window shade of the invention.

FIG. 1 shows a shade assembly 1 of the invention which includes: a fixed rail 3 that is preferably a top rail; a movable intermediate rail 5 that is adjacent and parallel to the fixed rail 3; and a fixed auxiliary rail 7 that is adjacent to the movable rail 5, is spaced from and parallel to the fixed rail, beyond the movable rail 5, and is preferably a bottom rail. The shade assembly 1 has a central form to correspond to a rectangular window opening (not shown). Suspended between the fixed rail 3 and the movable rail 5 is a conventional pleated shade 9 which is collapsible and extendible. The shade 9 is provided with a plurality of openings 11 for the passage of a pair of driving cords 13, 15 routed through the shade for moving the movable rail 5 and for the passage of a stationary support cable 17 to support the shade 9 in the form of a pleated panel. The shade 9 of FIG. 1 has three parallel columns of openings, a left column 11A adjacent the left side of the blind, a middle column 11B, and a right column 11C adjacent the right side of the blind.

The drive cords 13, 15 are wound about respective left and right drive spools 19, 21 with a least one cord winding. The cords are wound about the respective spools in reverse direction, meaning that drive cord 13 is wound from the left side 19A of the spool to the right side of the spool 19B in a clockwise winding and the right drive cord 15 is wound form the left side 21A of the spool 21 to the right side of the spool 21B in a counter-clockwise winding. The left and right cord drive spools are rotatably supported in a pair of left and right cradles 23, 23'. In FIG. 1, the two cradles 23, 23' are integrally formed as a single modular cradle part 24 to be fixed in the fixed rail 3 such that the spools can be operatively connected to the operating means of the blind. In the example shown in FIG. 1 this is a motor (M), a driven shaft 25 extends from the motor and through the spools 19, 21 such that rotation of the shaft 25 will drive the spools in rotation which in turn will lead to movement of the drive cords 13, 15 and to collapsing or extending the blind.

One cord section 13A of the first driving cord 13 when extending from the left spool 19 is guided to the left and along the fixed head rail until adjacent the left side of the blind it is routed with cord section 13B through the left column 11A of openings 11 downwardly and with cord section 13C into the movable rail 5 where it is guided rightwardly along the rail to a point 13D where it is attached to the other drive cord 15.

The drive cord section 13E of the first driving cord 13 when extending from the left spool 19 is guided to along the fixed head rail and with cord section 13F into the middle column 11B of openings 11 and downwardly through movable rail 5 and to the fixed or bottom rail 7, there cord section 13G is guided to the left end 7A of the bottom rail, cord section 13H is guided out the bottom rail and upwardly to the movable rail 5, and cord section 13I is guided into the movable rail 5 through the left end 5A and towards the right end of the movable rail and cord end 13K is attached to the left end of a first tension spring 27 which is retained in the movable rail 5. In this respect a portion of cord section 13E of the first drive cord 13 runs parallel to the bottom web of the cradle 23. To facilitate this routing the front and rear bottom webs 39,41 of the cradle 23 comprise the cord guides 47, 49, 51, 53 of the invention. This further explained in relation to FIG. 2.

The second drive cord 15 is routed in a mirror-image to the routing of the first drive cord, in which the left cord section 15A is routed like the mirror-image of the right cord section 13B. Thus cord section 15A is routed along the head rail towards and cord section 15B passes through the middle column 11B of the openings, through the movable rail 5 and into the bottom rail 7. Then the next cord section 15C runs the bottom rail 7 towards the right rail end 7B and portion 15D runs upwardly towards the movable rail 5. Into the movable rail runs cord portion 15E and the end portion 15F of is attached to a second tension spring 29. The tension springs 27, 29 are located opposite each other in the movable rail. The right cord section 15G of the second drive cord is routed in a mirror image to the routing of the left cord section 13A. Thus cord section 15G is routed through head rail 3 towards the right column of openings 11C and portion 15H runs through the right column 11C of the openings adjacent the right side edge of the blind. Then into the movable rail 5 runs portion 15I and cord end 15K is attached to cord end 13D The tension cable 17 is attached by a left cable end 17A to the fixed head rail 3, routed first through the left column 11A of openings 11, downwardly through the movable rail 5, then into and along the fixed tension rail 7 to the right and upwards out at the width wise location corresponding to that of the middle column 11B of openings, upwards through the movable rail 5, upwards through the middle column of openings 11B, upwards into the fixed head rail 3 and to the right parallel along the rail, out through an opening and downwards along the right column 11C of openings and through the movable rail 5 and downwards into the fixed bottom rail 7 and fixed thereto with a right cable end 17B. Preferably, one of the cable ends 17A/17B is connected to a cable tensioner 31 that will allow to adjust the tension of the cable. The tension cable 17 serves to keep the pleated panel in shape, preventing sagging and the like, and is especially convenient for slanted windows such as in a sunroom. The cable tensioner 31, preferably is in the shape of a tensioning slider, details of such a tensioning slider for tensioning the cable 17 are described in EP 0 860 577.

Apart from the position of the left and right cord drive spools are rotatably supported in a pair of left and right cradles 23,23' in the head rail, the cord routing and tension cable routing is conventional. Other routings are also possible, and do not influence the invention.

The cord and cable sections 13A-13K, 15A-15K, 17A-17B of the drive cords 13, 15 and tension cable 17 are indicated to facilitate reading the figures, but in use the cords move through the window covering as the spool is rotated in clockwise or counter-clockwise direction, and the covering moves relative to the tension cable.

Thus when retracting the shade 9 by moving the movable rail 5 towards the fixed rail 3, the left portion 13A of the first drive cord 13 is wound about the winding drum 19, and the right portion 13E of the first drive cord 13 is unwound from the drive spool 19. Similarly and as caused by reverse winding second drive cord 15 about the right cord spool 21, the mirror-image routing of the second drive cord 15 relative to the first drive cord 13, will move in the same way. Thus the left cord section 15A of the second drive cord 15 is unwound from the cord spool 21 and the right cord section 15G is unwound from the winding drum 21.

In deploying the shade 9, the cord portions 13A, 13E, 15A and 15G move in opposite directions. The motor M is adapted to reversibly power the winding drums 19, 21 for rotation in opposite directions.

With the electric motor (M) in position within the fixed rail 3, each cord drive spool 19, 21 is received in the left and right bearing blocks 35, 37, 35', 37' of the cradles 23, 23'. For this purpose each of the left and right bearing blocks 35, 37, 35', 37' is provided with a suitable bearing (B) and the drive spools each have left and right journals (J).

Figure 2:
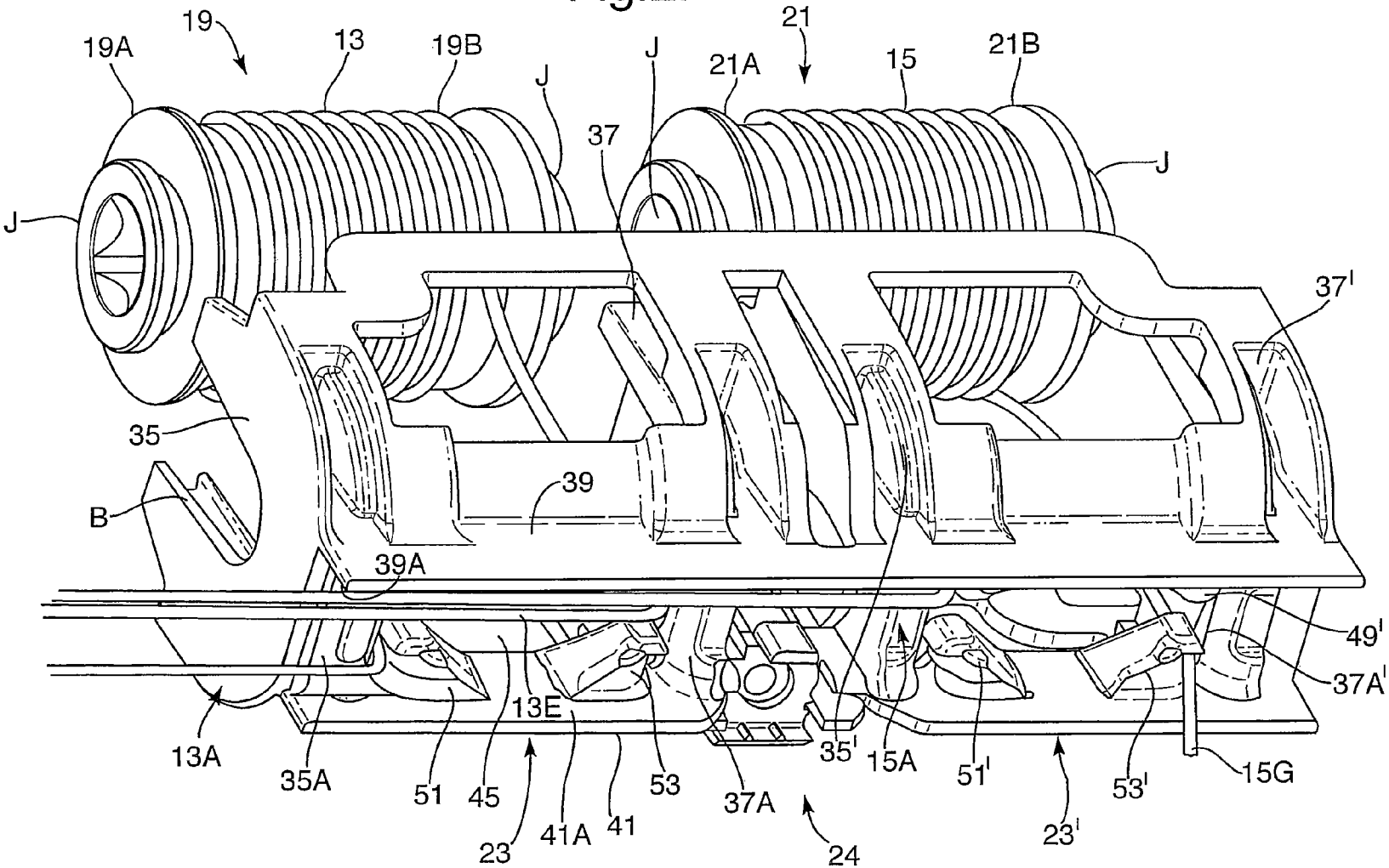
FIG. 2 is a partially exploded view of a cradle housing two cord spools which cradle includes the cord guiding means of the invention.

FIG. 2 shows in a partially exploded view, the cradles 23, 23' with the first and second cord spools 19, 21 with the first and second drive cords 13, 15 guided in directions appropriate for the cord routing as shown and described in relation to FIG. 1.

Since it is also possible to have separate cradles, and for clarity of the description, only the left cradle 23 is described in detail. The right cradle has like parts, and when described like reference numerals are used with an added suffix'.

As can be seen in FIG. 2 the cradle 23 includes a central opening 45 for the passage of the first driving cord 13. The cradle bottom opening 45 is lined by a front and rear web 39,41 extending between the inner base walls 35A,37A of the left and right bearing blocks 35, 37. Together with the left and right inner base walls35A, 37A the front and rear webs 39, 41 thus line and delimit the central bottom opening 45. Cord guides 47, 49, 51, 53 are provided on the inner surfaces of these lining walls 35A, 37A, 39A, 41A. In the embodiment of FIG. 2 the cord guides are provide on the 39A,41A of the front and rear webs 39,41 lining the opening 45.

Each cord guide projects 47, 49, 51, 53 inwardly into the opening 45 from a position P1, P2, P3, P4 on the inner surface 39A, 41A of the front or rear web. Each position P1-P4 is adjacent to, but not in contact with, the respective inner walls 35A, 37A of the left and right bearing block bases. In this manner a number of cord guiding spaces 55, 57, 59, 61 are created that are isolated from but in open connection to the bottom opening 45. Each cord guiding space includes a narrow entrance 63, 65, 67, 69.

These entrances 63, 65, 67, 69 are created by the position of the cord guide 47, 49, 51, 53 relative to the respective left or right inner wall 35A, 37A and by the shape of the cord guide.

Thus a first cord guide 47 projects from position P1 on the inner surface 39A of the front web 39, and position P1 is adjacent the left inner wall 35A of the left bearing block 35. A second cord guide 49 projects from position P2 on the inner surface 39A of the front web 39, and position P2 is adjacent the right inner wall 37A of the right bearing block 37. Third and fourth cord guides 51, 53 project from similar positions P3 and P4 on the inner surface 41A of the rear web 41.

All the cord guides are of similar shape, therefore only the first cord guide 47 on position P1 on the front web 39 is described. Similar parts of the other cord guides are indicated with suffixes on the reference numerals, a single suffix for second cord guide 49, a double suffixes for third cord guide 51 and a triple suffix for fourth cord guide 53.

The first cord guide 47 has a general hook like shaped body 71 and includes a cord guiding recess 73 opposite the inner wall 35A of the left bearing block 35. The cord guiding recess 73 lines the cord guiding space 55 of which the other portion is lined by the inner left base wall 35A. The narrow entrance 63 into the cord guiding space 55 is shaped a cord retaining flange 75 projecting under a slope from the guide body 71 towards the left inner base wall 35A and thereby creating the funnel-like entrance 63 between the sloped flange 75 and the left inner base wall 35A. After passing the entrance funnel 63 the cord guiding space 55 is relatively wide and slightly oval of shape. The shape of the space 55 and the entrance 63 make it relatively easy for a cord to be guided from the main opening into the cord guiding space and difficult for the cord to escape from this confined space. Thus during assembly of a cord driven blind, a drive cord section e.g. 13A can be easily threaded through the main opening 45 and subsequently laid around a cord guide suitable for the chosen cord routing. The shape and position of the cord guide ensure the cord to remain in its chosen cord guiding space during further assembly and/or during transport prior or after assembly. Also during mounting the blind the cords will remain in there designated space. The entrance 63 has a width that is equal or less than the cross-sectional dimension of a drive cord.

In use in the blind of FIG. 1, the portion of drive cord 13 directly preceding the cord section 13A and extending through the opening 45 of the cradle, runs through the cord guiding space 59 adjacent the third cord guide 51. When the blind is operated the cord portion 13A will run along the inner base wall 35A within guiding space 59. The portion of drive cord 13 directly preceding the cord section 13E and extending through the opening 45 of the cradle, runs through the cord guiding space 57 adjacent the second cord guide 49. When the blind is operated the cord portion 13E will run along recess 73 of the cord guide and between the front and rear base walls 39, 41 backwards along the head rail towards the centre column of openings 11B. For drive cord 15 on right spool 21 the portion of drive cord 15 directly preceding the cord section 15A and extending through the opening 45' of the cradle 23', runs through the cord guiding space 55' adjacent the first cord guide 49'. When the blind is operated the cord portion 15A will run along the inner base wall 35A' within guiding space 55'. The portion of drive cord 15 directly preceding the cord section 15G and extending through the opening 45' of the cradle 23', runs through the cord guiding space 61 adjacent the fourth cord guide 53'. When the blind is operated the cord portion 15G will run along recess 73' of the cord guide 53' almost straight down into the third column of openings 11C.

Figure 4:
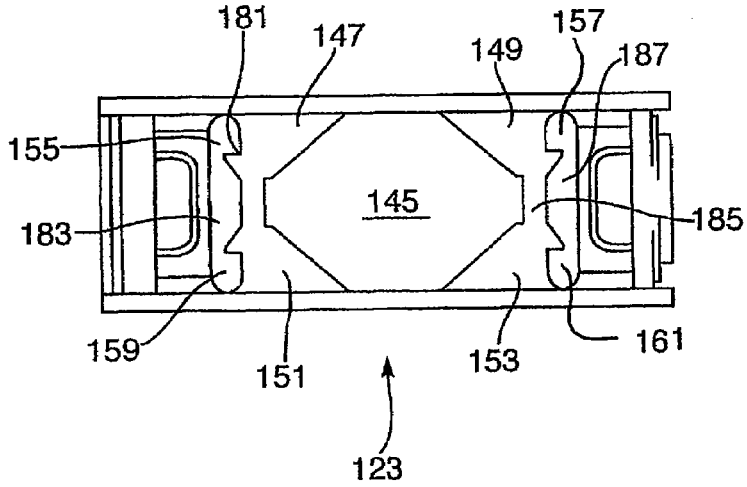
FIG. 4 is a bottom view of a cradle bottom with a second embodiment of cord guiding means.

FIG. 4 is a bottom view of the bottom of a second embodiment of the cradle 123 of the invention, to avoid repetition of description, like features have references supplemented by 100. The directly opposite first and third cord guides 147, 151 and second and fourth cord guides 149, 153 are connected by a first and second intermediate web 181, 185 respectively, thereby isolating the central opening 145 from the cord guiding spaces 155, 157, 159, 161. Instead the opposite first and third cord guiding spaces 155, 159 are in open connection with each other through a first intermediate space 183 and the opposite second and fourth cord guiding spaces 157, 161 are in open connection with each other through a second intermediate space 185. Thus during assembly of a cord driven blind, a drive cord section e.g. 13A, 15A can be easily threaded through the respective intermediate space 183, 187 and subsequently laid around a cord guide suitable for the chosen cord routing. Similarly to the first embodiment, the shape and position of the cord guide such as e.g. the funnel like entrance and the cord guiding recess, ensure that the cord remains in its chosen cord guiding space during further assembly and/or during transport prior or after assembly. Also during mounting and use of the blind the cords will remain in their designated spaces.

Figure 5:
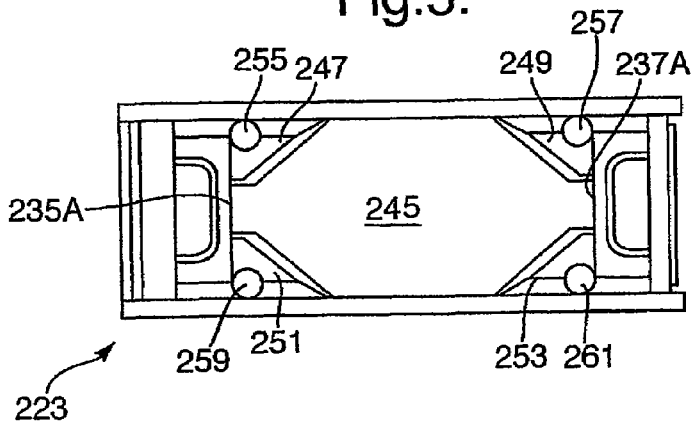
FIG. 5 is a bottom view of a cradle bottom with a third embodiment cord guiding means.

FIG. 5 is a bottom view of the bottom of a third embodiment of the cradle 223 of the invention, to avoid repetition of description, like features have references of the first embodiment supplemented by 200. Instead of joining the directly opposite cord guides, each cord guides 247, 249, 251, 253 is connected to the adjacent inner left or right base wall 235A, 237A. Thus the cord guiding spaces 255, 257, 259, 261 are completely isolated from the central opening 245 and there are no intermediate spaces connecting the cord guiding spaces.

In this third embodiment the cord guiding space through which a drive cord will run after assembly and be guided during use, has to be chosen during assembly. Later changes are only possible by re-threading the drive cord.

Figure 3:
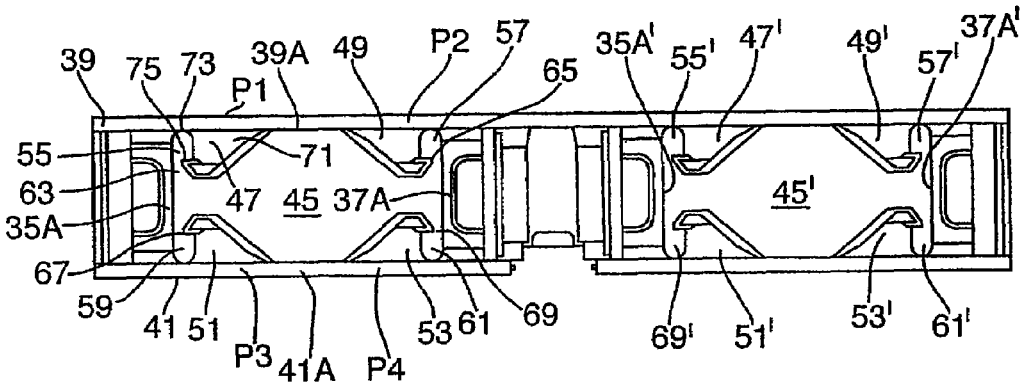
FIG. 3 is a bottom view of the cradle bottom.

As can be seen from FIGS. 1, 2 and 3, in the first embodiment, a pair of identical cradles 23,23' are interconnected and together form a single part to be mounted in the headrail. The invention allows for use of modular cradle sets like the one of FIG. 1. The cord guides 47-53 and 47'-53' allow the modular cradle part to be placed at any location along the head rail because the cords can be placed about any suitable cord guide, and either run along one of the inner base walls 35A, 37A, 35A', 37A' or along any of the cord guiding recesses 73, 73' of the cord guide body 71. Thus the cords can run either straight down into a column of openings of the shade, are be guided to run along the head rail before turning into a column of openings.

Likewise the single cradle 123, 223 embodiments can also be placed at any location along the head rail because the cords can be placed about any suitable cord guide.

This invention is, of course, not limited to the above-described embodiments which may be modified without departing from the scope of the invention or sacrificing all of its advantages. In this regard, the terms in the foregoing description and the following claims, such as "left", "right", "adjacent", "vertical", "longitudinal", "upper" and "lower", have been used only as relative terms to describe the relationships of the various elements of the architectural covering and bearing block of the invention. For example, the pleated shade 9 could be replaced by a conventional slatted or cellular type shade, such as a plurality of parallel blind slats carried by an appropriate number of ladder cords, i.e., a venetian blind.

Also in this regard, the cradles 23, 23' of the example are provided with four cord guides. However one could suffice with two cord guides that are diagonally opposite each other. Alternatively even a single cord guide could also suffice. However in such cases the additional advantage of keeping the drive cords in place during assembly, transport and mounting of the window covering would be limited.

The cord guides could project from the inner base walls 35A, 37A, instead from the front and rear bottom webs 39, 41.

The electric motor (M) could, if desired, be replaced by a manually operated driving system for reversibly rotating the cord winding drums 19, 21. The electric motor (M), as shown, is received in a pair of mounting supports which are receivable within the contoured profile of the fixed rail 3. Other mounting arrangements are also possible, such as integrally forming a cradle for the spools and the motor, or by shaping one end of the cradle as a support for the motor and thus needing only one mounting support for the opposite end of the motor (M).

Instead of a rectangular shape the shade assembly 1 can also be of a non-rectangular shape such as triangular or octagonal in order to cover architectural openings of such shapes in e.g. sunrooms or conservatories.

Instead of two drive cords 13, 15 that are attached in the movable rail by cord ends 13D and 15K, a single drive cord can be routed through the blind following the routing of the cords described in relation to FIG. 1. Of course the inventions is not limited to this particular cord routing.

The invention claimed is:

1. A window covering comprising:

a fixed first rail;

a movable second rail, parallel to the fixed first rail;

a collapsible and extendible blind or shade which is between the fixed first rail and the movable second rail;

at least one rotary drive spool mounted on the fixed first rail;

a drive cord windable about the drive spool and operatively connected to the movable second rail to move the movable second rail toward and away from the fixed first rail, means for reversibly rotating the drive spool to move the drive cord and affect movement of the second movable rail to collapse or extend the blind or shade; and a cradle on the fixed first rail in which the drive spool is rotatably mounted, said cradle having a pair of left and right interconnected bearing blocks in side-by-side relationship, each having inner walls to define a central opening through the cradle and through which the drive cord extends, the cradle further including at least one cord guide extending horizontally from at least one of the inner walls, said cord guide having a free end projecting inwardly into said central opening from an inner surface of said inner wall which reroutes and guides the drive cord along and within a portion of the fixed rail before the cord extends through or parallel to the blind or shade.

2. The cradle of claim 1, wherein said at least one cord guide includes a body projecting from said at least one of the inner walls and wherein said body defines a cord guiding space between said body and one of the inner walls.

3. The cradle of claim 2 wherein the cord guiding space is in open connection with the central opening by an entrance.

4. The cradle of claim 3 wherein said entrance includes at least a portion thereof having a minimal width that is equal to or slightly less than the cross-sectional dimension of a drive cord.

5. The cradle of claim 4 wherein the cord guide projects from said at least one inner wall into said central opening and said entrance is shaped by a cord retaining flange on said guide body sloping toward said at least one inner wall and thereby creating the funnel entrance forming an open connection between the central opening and the cord guiding space.

6. The cradle of claim 1 wherein said at least one cord guide has a hook shaped body.

7. The cradle of claim 6 wherein said at least one cord guide further includes a guiding recess.

8. The cradle of claim 1 further including a cord guiding space isolated from but in open connection with said central opening.

9. The cradle of claim 8 further including a funnel entrance into said cord guiding space.

* * * * *